United States Patent [19]

Stapley et al.

[11] Patent Number: 4,926,665

[45] Date of Patent: May 22, 1990

[54] REMOTELY PROGRAMMABLE KEY AND PROGRAMMING MEANS THEREFOR

[75] Inventors: Gerald Stapley, Godalming; Geoffrey Tate, Haslemere; Derek Hardisty, Brookwood, all of England

[73] Assignee: Security Services PLC, London, England

[21] Appl. No.: 166,983

[22] Filed: Mar. 11, 1988

[30] Foreign Application Priority Data

Mar. 12, 1987 [GB] United Kingdom ..... 8705892

[51] Int. Cl.[5] ..... E05B 49/00

[52] U.S. Cl. ..... 70/277; 70/382

[58] Field of Search ..... 70/382, 277, 393, 413, 70/278; 340/825.3, 825.31, 825.34, 825.5

[56] References Cited

U.S. PATENT DOCUMENTS 4,525,805 6/1985 Prosan ..... 364/900
4,665,397 5/1967 Pinnow ..... 340/825.56
4,766,746 8/1988 Henderson ..... 70/63
4,789,859 12/1988 Clarkson ..... 340/825.31

FOREIGN PATENT DOCUMENTS 238361 9/1987 European Pat. Off. .
2188762 10/1987 United Kingdom .

*Primary Examiner*—Robert L. Wolfe
*Attorney, Agent, or Firm*—Antonelli, Terry & Wands

[57] ABSTRACT

A key holding system comprises one or more locks responsive to key codes stored by a programmable key to enable the selective operation of that lock. The key is programmed by a key programmer carried by the key holder or installed in a vehicle. A database of key codes related to individual locks is maintained at a remote station and the code required by the key to operate a particular lock is communicated, subject to any required validation, e.g., as to the identity of the key holder, to the key programmer. Various methods of increasing security of the system are disclosed.

21 Claims, 2 Drawing Sheets

REMOTELY PROGRAMMABLE KEY AND PROGRAMMING MEANS THEREFOR

This invention relates to the remote programming of a programmable key.

Locks are known for securing doors which may employ mechanical, electrical or electronic release mechanisms. The various release mechanisms are normally actuated by keys which may be coded magnetically, electronically or by nature of their shape. The corresponding locks are provided with a device to read the code, for unlocking purposes.

The present invention contemplates an arrangement whereby, in respect of one or more locks, there is provided a programmable key which can be programmed with the key code required to operate a particular lock in a manner which enables the programming to take place at a location which is remote from that where the code is held.

According to a first aspect of the invention, there is provided, for use with a lock having means for responding to the detection of a predetermined key code stored on a key, the combination of:

(a) at least one such key adapted to store data comprising a code; and (b) key programming means comprising means for receiving from a remote location a signal indicating a key code to be stored by the key and for causing the key to store that code.

A second aspect of the invention provides a method of operating a key holding service in respect of at least one lock adapted to respond to the detection of a key code stored on a key, comprising the steps of:

(a) maintaining at a location remote from the, or each, lock, a database in which is stored a key code required to operate the or each lock;

(b) transmitting via a data link an indication of that code to a key programming means in the vicinity of the lock; and (c) at the programming means, storing in the key the key code required to operate the lock.

As well as providing the code required to open a particular lock, the key code can be indicative, inter alia, of any or all of the following: the identity of the keyholder permitted to use it; the period during which it is valid; the number of times the key may be used to operate the lock; the fact that the key code should be erased by the lock on the next occasion of use, of the key to open the lock.

For use in the present invention, there may be provided at least one lock having means for reading data stored on the key, and means for determining whether or not the lock should operate dependent on data read from the key. The determining means may be responsive to data stored on the key and indicating the code required to operate the lock and to data stored on the key indicating circumstances of authorization of the key to open the lock; the circumstances of authorization may include the time of day and/or the number of times the key is to be permitted to operate the lock. The lock may have means for erasing or otherwise invalidating the key code stored on the key once the key has been used a predetermined number of times.

The lock may be responsive to data stored in the key to alter or erase the key code and the lock and/or the programming means may have means for storing data on the key.

The data stored on the key may include an indication of the person by whom the programming means was operated or an authorization code relating to that person.

The system of the present invention further comprises a remote station having means for storing key codes related to individual locks and means to transmit a selected one of the keycodes to the key programming means via a communication link. The remote station may comprise means operative in response to a signal from the key programming means to transmit thereto the required key code. The remote station may comprise means operative to require validation of the identity of the key holder to be transmitted thereto before providing the key code for the key.

The key programming means may be installed in a vehicle or be in personally portable form.

The invention may therefore be used in order to provide a key holding service where the codes of any number of locks may be held on one or more secure centralized databases and the code for a particular lock which it is desired to open may be retrieved from a selected database, transmitted over a (preferably secure) communications link and programmed into the key.

This would, for example, enable an operative of the key holding service to gain temporary access to premises, for the purpose for example, of reacting to an alarm going off or for a routine, regular visit.

Alternatively, the programmed key could be used for deactivating or resetting a burglar alarm or other event or status monitoring or reporting system in order to allow entry of authorized personnel, or in the event of the alarm being sounded accidentally. The equipment necessary to access the centralized data base, and to program the key may be a portable device which may be suitable for installation in a vehicle or which may easily be carried about the person, e.g., an operator of the key holding service whether on foot or not. The invention is applicable to any situation in which a code required for a key, such as a binary data word or series of pulses, is held in a secure central data base, and is only physically applied to a key when required to operate that lock on one or more specific occasions.

A specific embodiment of the invention will now be described by way of non-limitative example, with reference to the accompanying drawing in which.

Figure 1:
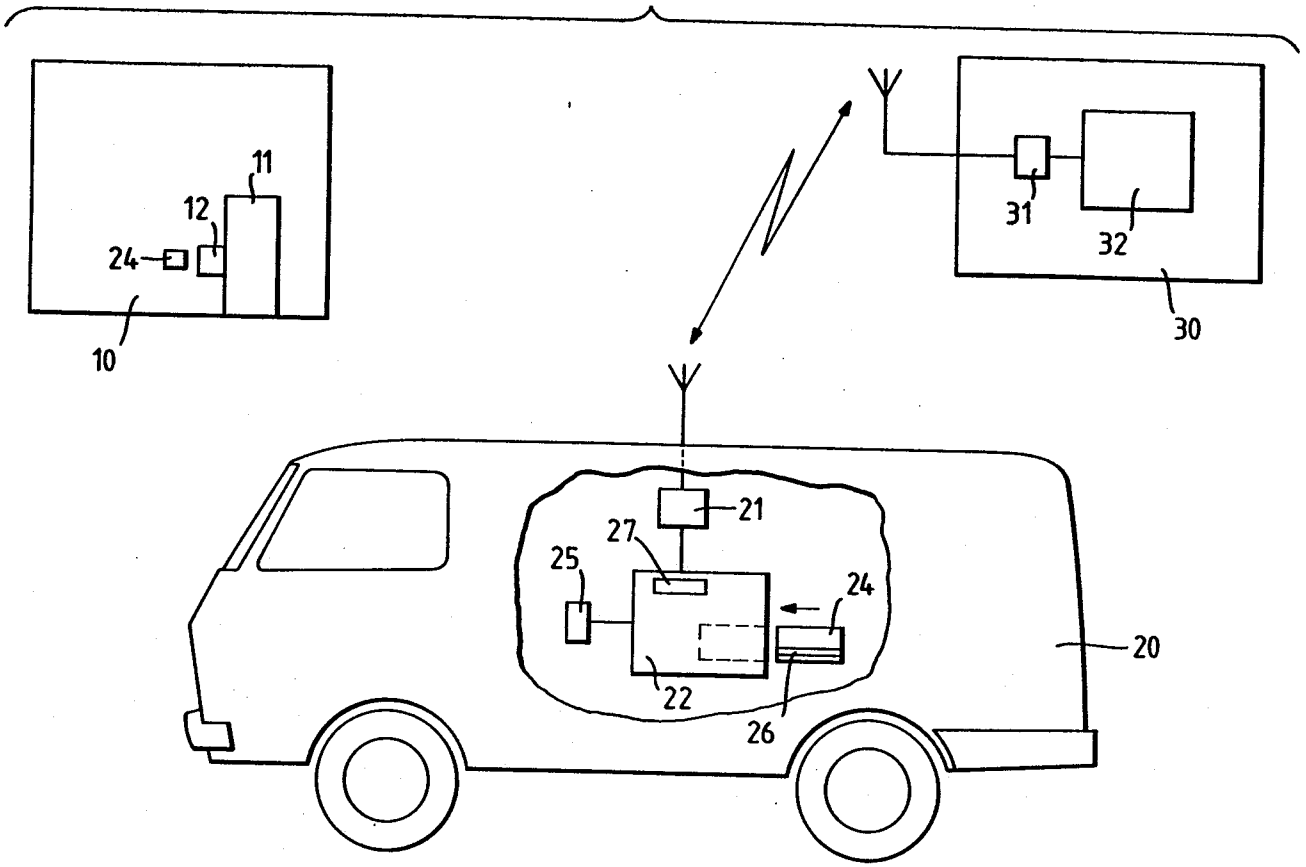
FIG. 1 is a schematic diagram of an embodiment of the invention.

In particular there will be described the application of the invention with reference to a security service.

The system 1 comprises a control center 30 having a computer 32 in which there is held a database of key codes, one or more mobile key programmers 22, each possibly installed in a vehicle 20, and a plurality of electronic locks 12 securing the doors 11 of premises 10 for which a keyholding security service is provided. The computer 32 may be a mainframe, mini, micro or other suitable type of computer, and is linked to a transceiver 31 to allow communication with the key programmers 20 by, for instance, a radio link or cellular radiotelephone. There is a corresponding transceiver 21 installed in each of the vehicles 20 which is connected to a key programmer 22 appropriate to programme the key 24. The transmitted code can be in encrypted form and the control center 30 and key programmers 20 provided with scramblers/unscramblers for added security. Hence, should security personnel require access to particular premises 10, the code required to open the lock 12, can be requested from the computer 32, and sent via the communication link to the key programmer 22, which then programs a key 24. Each of the key programmers 22 may have a key pad 25 or other input device for the purpose of inputting the request for a code, and also for transmitting to the control center 30 other information such as an authorization code.

The key programmer 22 may also transmit a time check and/or other validation information so that the control center 30 can be sure it is receiving a live and legitimate transmission, and not a signal which has been previously intercepted and recorded by an authorized person. The key programmer 22 is provided with a means for writing a code onto the key 24. The key 24 may be in the form of a plastic card to which is attached or in which is embedded a strip of magnetic material 26. The key programmer 22 magnetically records the required code or codes on the key 24 which may then be used in a lock 12. Alternatively the key may be an electronic device wherein the code can be stored in an electronic memory such as a PROM, EPROM, EAROM or non-volatile RAM.

Thus a key 24 may be carried by, for example, a security guard and may be used to open any one of many locks after it has had the code for that particular lock 12 recorded on it by the key programmer 22.

There may also be encoded on the key 24 instructions for the lock 12 to allow use of the key 24 only a set number of times and/or only at a specified time and the key 24 can also carry an instruction to the lock to erase the code from the key 24 after use.

If the need arises for a security guard to gain access to a property, the central computer instructs a remote key programmer 22 to record the required code on the guard's key thus removing any need to call the owner/-key holder of property concerned.

The guard may also inspect a number of sites, but will only require a single key. Furthermore, should that key be lost or stolen, it is likely that it will have only one code recorded on it, if any at all, and there would be no indications as to which, of many premises, it has been coded to allow entry. Hence the system provides increased security for the properties concerned.

The programmer 22 may be provided with a display 25 for the remote computer 32 to display messages to the key holder, for example a prompt for the key holder to input identity validation information.

In addition, there may also be encoded on each of the keys an identification code which enables the central computer to distinguish between key holders, authorized or unauthorized, when requests are made for the encoding of a key. Such an identification code might be a sequence of numbers which the key holder must input via a numeric key pad. Alternatively an authorized user may be recognized by transmission of a video picture of voice print to the central computer where records of such identifications are stored.

There may also be encoded on the key other information such as the time and/or date range for which the key is valid and/or whether or not the code held on it is due for erasure on subsequent use. In addition, any or each lock may be given standing instructions by the central computer only to respond to an inserted key, even having the correct code or not, during part of the day. This can provide a facility, for example, to enable certain key holders, such as delivery men, to gain access only at certain times, and even then, possibly only to part of the premises.

It should be appreciated that the invention is not restricted to magnetically encoded keys, nor is its application restricted to the provision of an external security service, but may be used for other security reasons, for example, enabling the operation of particular apparatus, or provision of an access control system. The invention is applicable in any situation where a key and lock are used. It is not limited to the locking of doors and the like nor even to security applications generally. It can also be applied, for example, where locking of devices is provided for any one of a variety of purposes, for example in inhibiting unauthorised use.

Figure 2:
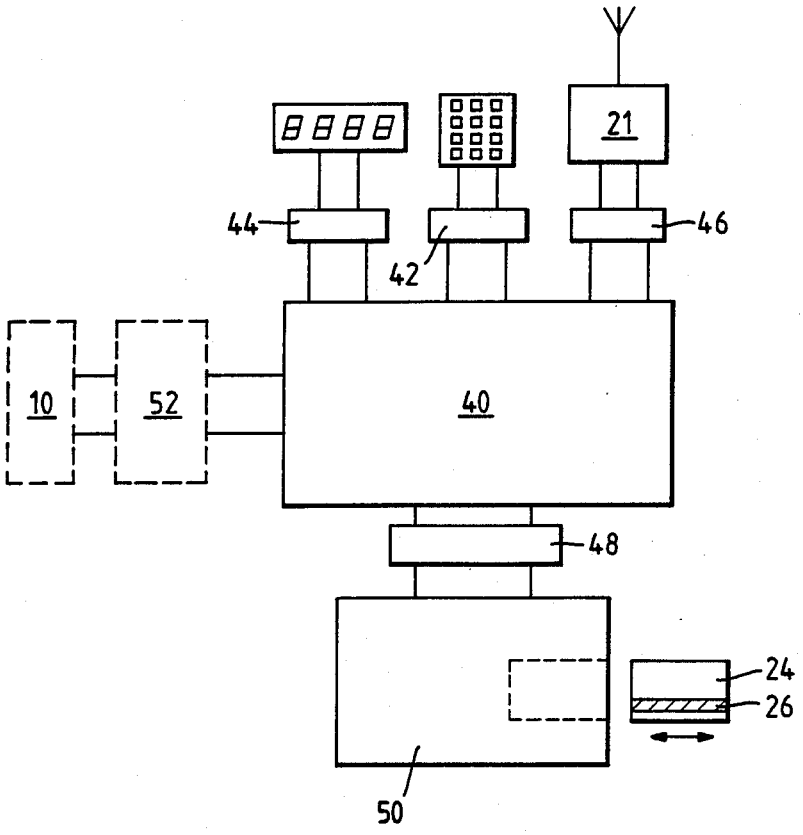
FIG. 2 illustrates the elements of the key programmer 22.

FIG. 2 illustrates the elements of one form of the key programmer 22. It will be seen that it is based around a suitably programmed microprocessor 40 which has interfaces 42 and 44 for the keypad 25 and display 27, respectively and interfaces 46 and 48 with the transceiver 21 and a key code reading and writing mechanism 50. The microprocessor 40 uses the interface 46 to control the transceiver 21 to exchange digital data with the remote computer 24.

The key-code reading and writing mechanism is responsive to digital commands applied to it via the interface 48 to scan the key code recorded on the magnetic strip 26 of a key 24 and to communicate that code back to the microprocessor 40; further it is responsive to command data from the microprocessor 40 to write prescribed data including the required key-code for a particular lock onto the magnetic strip 26.

It will be appreciated that a simplified version of the circuitry illustrated in FIG. 2 may be used in the locks 10; for such use, the interfaces 42, 44 and 46 may be omitted, an interface 52 to control the lock mechanism may be added and the control program of the microprocessor may be adapted to provide the required response of the lock to insertion of a key 24.

We claim as our invention:

1. For use with a lock having means to detect a predetermined key code stored on a key and means for responding to said detection to operate the lock, the combination of:

(a) at least one such key for storing data comprising one of a plurality of key codes;

(b) mobile key programming means comprising means for receiving from a remote station a transmitted signal indicating said key code to be stored by the key and for causing the key to store that key code wherein said mobile key programming means is adapted to be taken to a location in the vicinity of the lock, to receive said signal and to cause the key to store the key code at said location; and wherein (c) each key and storage of said data on each key is such as to require the key code indicated by the transmitted signal to be stored in the key be use of the mobile key programming means.

2. A combination according to claim 1, wherein the key code is indicative of any identity of a keyholder permitted to use the key code.

3. A combination according to claim 1, wherein the key code includes code indicative of a period during which the key code is valid.

4. A combination according to claim 1, wherein the key code includes code indicative of a number of times the key may be used to operate the lock.

5. A combination according to claim 1, wherein the key code includes code indicative of the fact that the key code should be erased by a lock on the next occasion of use of the key to open the lock.

6. A combination according to claim 1, further comprising at least one lock having means for reading data stored on the key, and means for determining whether or not the lock should operate dependent on data read from the key.

7. A combination according to claim 6, wherein the determining means is responsive to data stored on the key and indicating the code required to operate the lock and to data stored on the key indicating circumstances of authorization of the key to open the lock.

8. A combination according to claim 7, wherein, the circumstances of authorization include a time of day.

9. A combination according to claim 7, wherein circumstances of authorization include a number of times the key is to be permitted to operate the lock.

10. A combination according to claim 6, wherein the at least one lock has means for erasing or invalidating the key code stored on the key once the key has been used a predetermined number of times.

11. A combination according to claim 10, wherein the lock is responsive to data stored in the key to alter or erase the key code.

12. A combination according to claim 6, wherein at least one of the lock and the programming means has means for storing data on the key.

13. A combination according to claim 1, wherein the data stored on the key includes an indication of a person by whom the programming means was operated or an authorization code relating to that person.

14. A combination according to claim 1, and further comprising a remote station having means for storing key codes related to individual locks and means to transmit a selected one of the keycodes to the key programming means via a communication link.

15. A combination according to claim 14, wherein the remote station comprises means operative in response to a signal from the key programming means to transmit thereto a required key code.

16. A combination according to claim 15, wherein the remote station comprises means operative to require validation of the identity of the key holder to be transmitted thereto before providing a key code for the key.

17. A combination according to claim 1, wherein the key programming means comprises means for displaying to an operator messages from the remote station.

18. A combination according to claim 1, wherein the key programming means comprises means for inputting messages from an operator and for transmitting them to a remote station.

19. A combination according to claim 1, wherein the key programming means is installed in a vehicle.

20. A combination according to claim 1, wherein the key programming means is in a personally portable form.

21. A method of operating a key holding service for at least one lock for detecting a key code stored on a key and for responding to said detection, comprising the steps of:

(a) maintaining at a location remote from each lock a database in which is stored a key code required to operate the or each lock;

(b) transmitting via a data link an indication of that code or one of other codes to a mobile key programming means in the vicinity of the lock; and (c) at the programming means, storing in the key a single key code required to operate the lock.

* * * * *